US008820125B1

(12) United States Patent
Dolev

(10) Patent No.: US 8,820,125 B1
(45) Date of Patent: Sep. 2, 2014

(54) PADLOCK ASSEMBLY

(71) Applicant: Moshe Dolev, Udim (IL)

(72) Inventor: Moshe Dolev, Udim (IL)

( * ) Notice: Subject to any disclaimer, the term of this patent is extended or adjusted under 35 U.S.C. 154(b) by 0 days.

(21) Appl. No.: 13/910,143

(22) Filed: Jun. 5, 2013

(51) Int. Cl.
*E05B 67/22* (2006.01)
*E05B 67/02* (2006.01)

(52) U.S. Cl.
CPC ..... *E05B 67/02* (2013.01)
USPC ..... 70/38 A; 70/52; 70/53; 70/56; 70/417

(58) Field of Classification Search
USPC ..... 70/38 R, 38 A, 38 B, 38 C, 52–56, 417
See application file for complete search history.

(56) References Cited

U.S. PATENT DOCUMENTS 4,180,996 A * 1/1980 Lebrecht ..... 70/52
4,405,161 A * 9/1983 Young et al. ..... 285/80
4,548,058 A * 10/1985 Bahry et al. ..... 70/56
4,763,496 A * 8/1988 Evans et al. ..... 70/38 A
5,417,092 A * 5/1995 Iu ..... 70/38 A
5,755,121 A * 5/1998 Crass ..... 70/52
5,845,520 A * 12/1998 Dolev ..... 70/37
6,769,277 B1 * 8/2004 Chang ..... 70/52
7,412,855 B2 * 8/2008 Dolev ..... 70/56
7,458,240 B1 * 12/2008 Miao ..... 70/21
8,020,414 B2 * 9/2011 Pitisethakarn ..... 70/14
8,347,660 B2 * 1/2013 Guenther ..... 70/52
2004/0139772 A1 * 7/2004 Chang ..... 70/52
2005/0199019 A1 * 9/2005 Marcelle et al. ..... 70/38 A

* cited by examiner

*Primary Examiner* — Suzanne Barrett
(74) *Attorney, Agent, or Firm* — Dekel Patent Ltd.; David Klein

(57) ABSTRACT

A padlock assembly includes two padlock halves fastened with at least one fastener, and a cylinder lock assembled with the padlock halves. A shackle has legs that are receivable in the padlock halves and lockable with the cylinder lock. The padlock halves are interlocked with the shackle such that even if the at least one fastener is removed, if the shackle is in a locked position with the cylinder lock, the two padlock halves cannot be separated from each other.

12 Claims, 7 Drawing Sheets

PADLOCK ASSEMBLY

FIELD OF THE INVENTION

The present invention relates generally to padlocks and particularly to a padlock assembly with a cost efficient construction and anti-tampering features.

BACKGROUND OF THE INVENTION

Padlocks are commonly used to lock a hasp having a slot through which there is a projecting staple. A prior art padlock typically includes a shackle or bow which fits through the loop of the staple and prevents the staple from removal through the hasp.

Padlocks are used in a variety of applications, including, for example, with enclosures such as lockers, storage sheds, and various gates and doors. A typical padlock includes a generally rectangular lock body having a generally U-shaped shackle extending from one end and a keyway disposed on an opposite end. When a proper key is inserted in the keyway, a key cylinder within the lock body may be rotated to disengage a locking mechanism from the shackle, allowing the shackle to slide out of the lock body until a short leg of the shackle is fully removed from the lock body, allowing removal of the lock from a hasp or other such portion of an enclosure to be locked.

Shackle protectors are also known, such as the protector of U.S. Pat. No. 4,548,058 to Dolev and Bahry. U.S. patent application Ser. No. 13/764,904 to Dolev describes a bar lock assembly with one or more protective hasp members.

SUMMARY

The present invention seeks to provide a padlock assembly with a cost efficient construction and anti-tampering features, as is described more in detail hereinbelow. In one embodiment, the padlock has two padlock halves that are interlocked with a shackle. This means that even if the padlock halves were not fastened with fasteners, once the shackle is in the locked position, the two padlock halves cannot be separated from each other. In another embodiment, the padlock has two identical padlock halves. In another embodiment, the padlock is assembled in protective hasp members such that even if the shackle has no bar connecting the shackle legs, the padlock assembly remains intact in the protective hasp members.

BRIEF DESCRIPTION OF THE DRAWINGS

The present invention will be understood and appreciated more fully from the following detailed description, taken in conjunction with the drawings in which.

DETAILED DESCRIPTION

Figure 1:
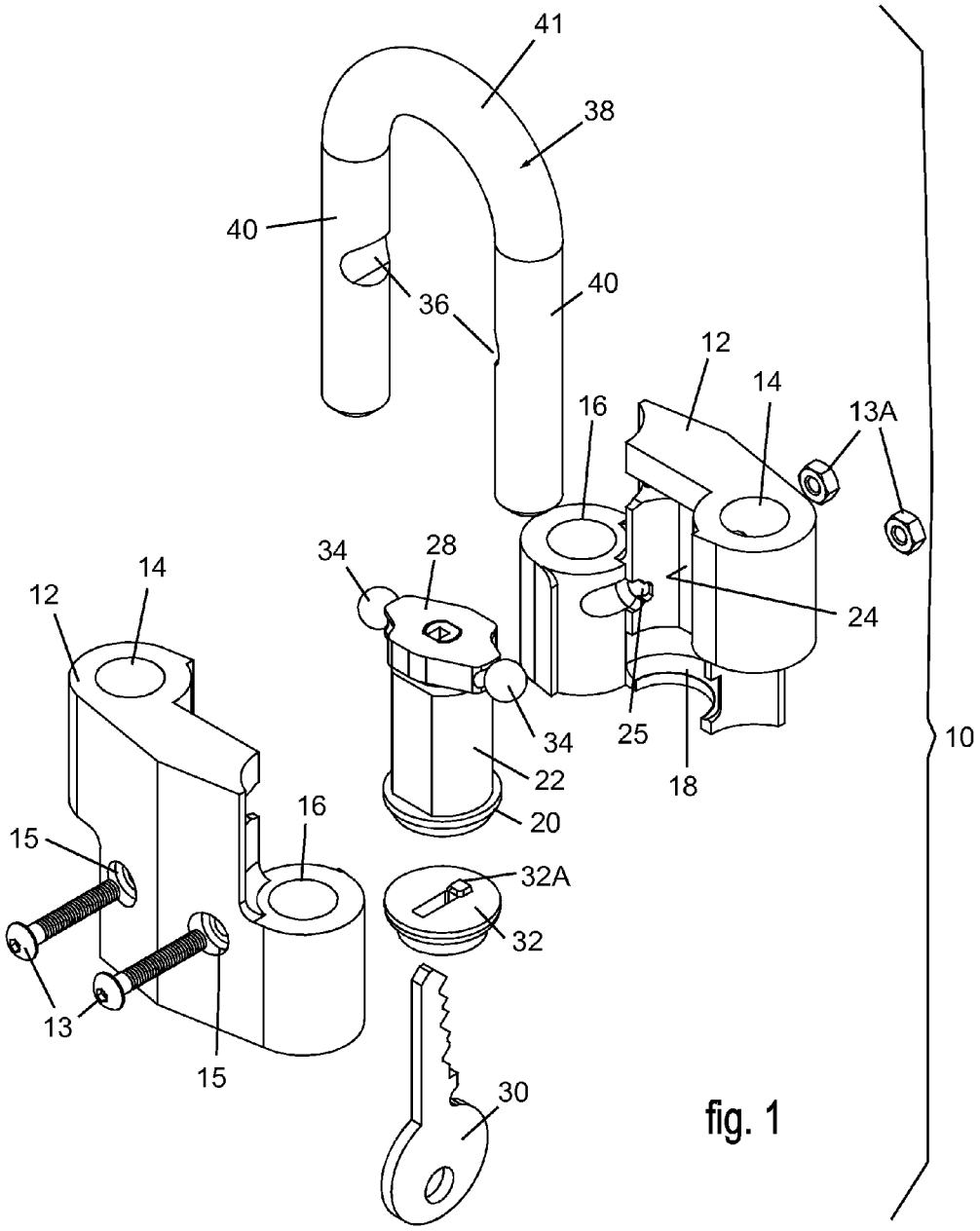
FIG. 1 is a simplified exploded illustration of a padlock assembly, constructed and operative in accordance with an embodiment of the present invention.

Reference is now made to FIG. 1, which illustrates a padlock assembly 10, constructed and operative in accordance with a non-limiting embodiment of the present invention.

Figure 2:
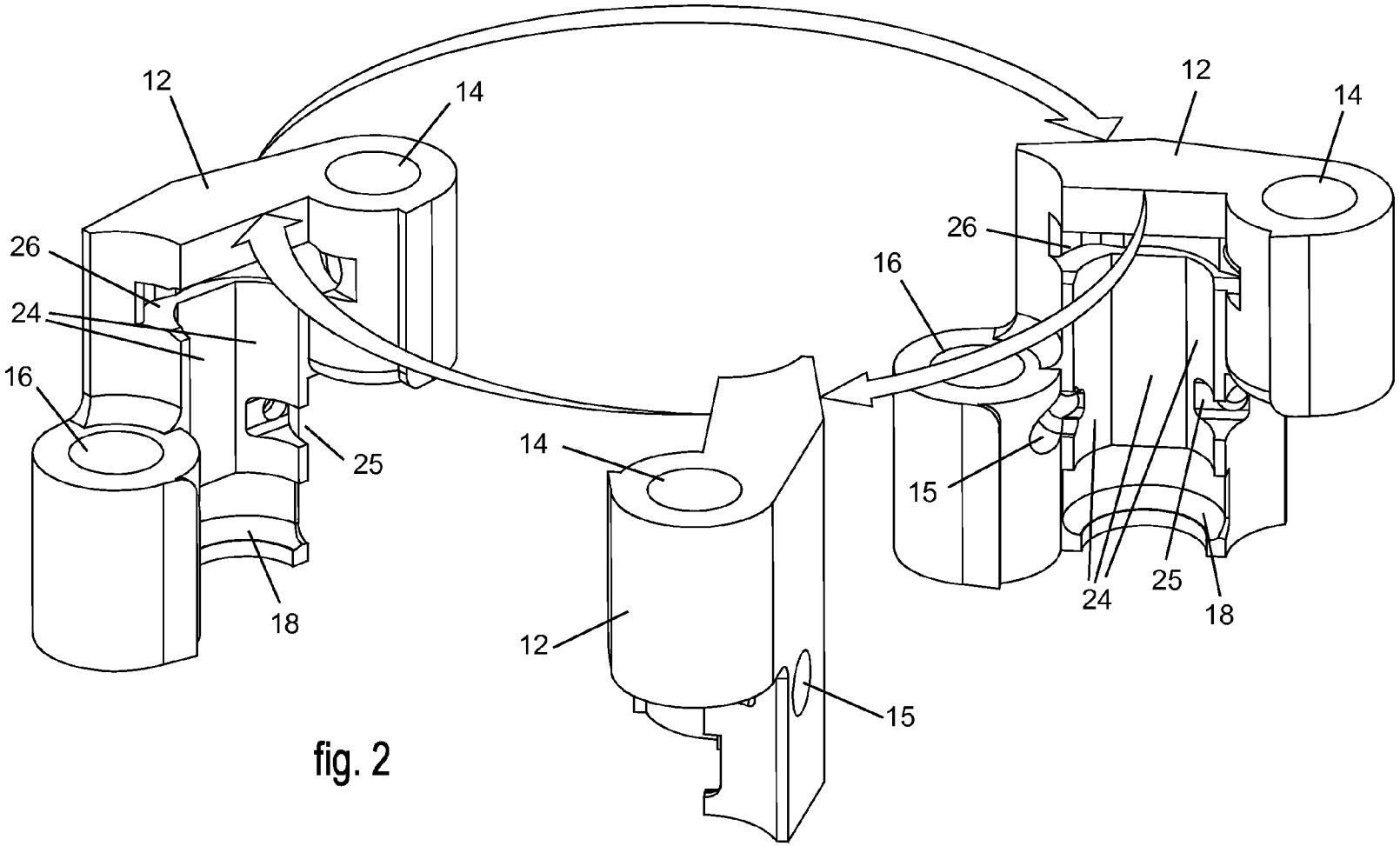
FIG. 2 is a simplified pictorial illustration of padlock halves of the padlock assembly of FIG. 1, clearly showing that the halves are identical and not minor images of each other.

Padlock assembly 10 includes two padlock halves 12 fastened together with one or more mechanical fasteners 13, which in this case are threaded fasteners (screws 13 and nuts 13A). Although padlock halves 12 may be different from each other, in accordance with an embodiment of the invention, they are identical. This is advantageous because it reduces part counts, inventory and manufacturing costs, and makes assembly easier. FIG. 2 clearly shows such an embodiment in which the halves 12 are identical and not minor images of each other.

As seen in FIGS. 1 and 2, each padlock half 12 includes first (typically upper) and second (typically lower) shackle receiving members 14 and 16, respectively. When assembled, the first shackle receiving member 14 of one of the halves sits over the second shackle receiving member 16 of the other half. Each padlock half 12 includes a first groove 18 for receiving therein a front rim 20 of a cylinder lock 22. The inside of each padlock half 12 is shaped to accommodate the contour of cylinder lock 22. For example, although the body of cylinder lock 22 may be cylindrical (with a protruding lug or key or other element to prevent rotation), in a preferred embodiment, the body of cylinder lock 22 is prismatic (that is, it has flat or curved facets or a combination of flat and curved facets). In such a case, as is illustrated, the inside of each padlock half 12 is accordingly prismatic with walls 24. One of the walls 24 may have a cutout 25 to enable drilling holes 15 for receiving the fasteners 13.

Each padlock half 12 includes a second groove 26 for receiving therein a locking cam 28 and locking balls 34 (FIG. 1) which are mounted at the end of cylinder lock 22. As is well known in the art, locking cam 28 is rotated by rotating a plug 17 (shown in FIG. 9) of cylinder lock 22 by means of a key 30 (FIG. 1) inserted in the keyway 19 (shown in FIG. 9) of cylinder lock 22.

An anti-tampering disk 32 (FIG. 1) may be provided at the entrance to the keyway, as is well known in the art. Disk 32 may also be received in first groove 18. Disk 32 may be provided with a lug 32A that prevents rotation of disk 32 because it is nominally obstructed by a softer portion of the cylinder lock 22. Upon a vandalistic attempt to drill through disk 32, the softer portion shears and lug 32A is no longer obstructed, so that disk 32 now rotates freely and prevents drilling into cylinder lock 22. It is noted that since the padlock is assembled from two padlock halves 12, disk 32 may be assembled into one padlock half and then covered over by the other half; this enables disk 32 to be of a greater diameter than the cylinder lock 22.

Figure 5:
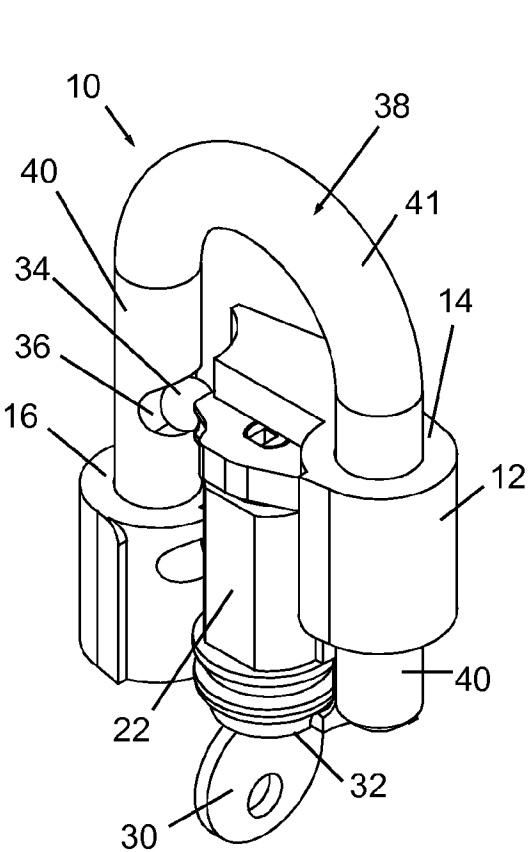
FIG. 5 is a simplified illustration of the padlock assembly of FIG. 1, with one padlock half removed and showing the shackle locked with the cylinder lock.

As seen in FIG. 1, locking cam 28 includes two locking balls 34 (e.g., spring-loaded balls) that lock against two grooves 36 formed in legs 40 of a shackle 38 (also seen in FIG. 5). A curved bar 41 (FIGS. 1 and 3-5) extends horizontally between the tops of the shackle legs 40. As can be seen, shackle legs 40 go through both shackle receiving members 14 and 16, which is one way of providing the interlocking feature.

Figure 4:
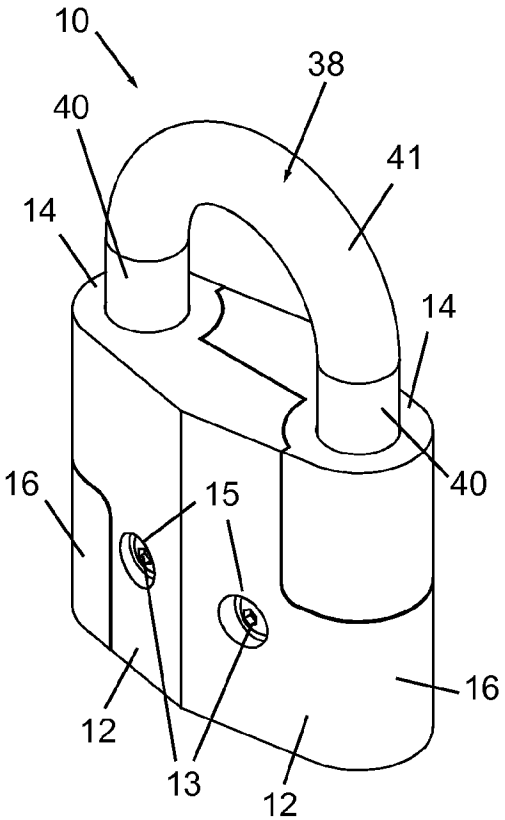
FIG. 4 is a simplified pictorial illustration of the padlock assembly of FIG. 1, with the padlock halves fastened together with mechanical fasteners (screws), in accordance with an embodiment of the present invention.

In the embodiment of FIGS. 1 and 4, the padlock halves 12 are fastened together with one or more threaded fasteners 13 (e.g., screws and nuts) through holes 15 which may be formed with a counterbore.

Figure 3:
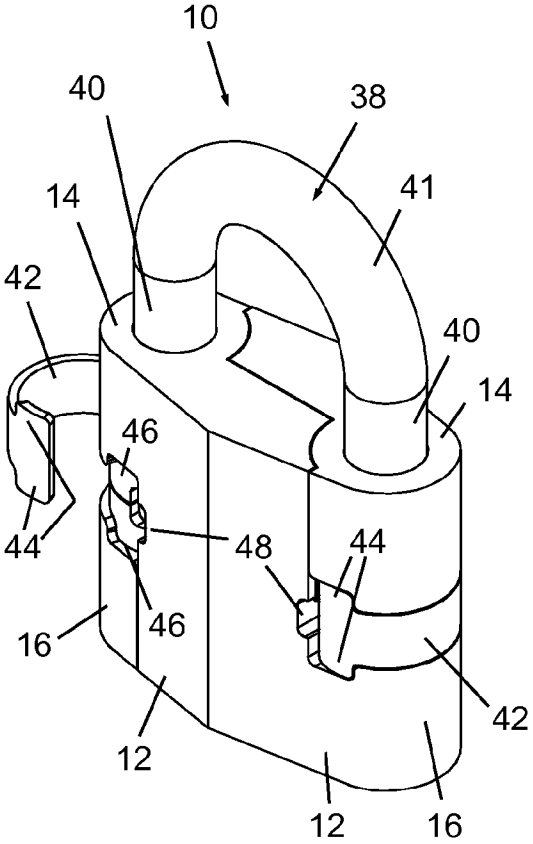
FIG. 3 is a simplified pictorial illustration of the padlock assembly of FIG. 1, with the padlock halves fastened together with mechanical fasteners (resilient clasps), in accordance with an embodiment of the present invention.
Figures 6, 7:
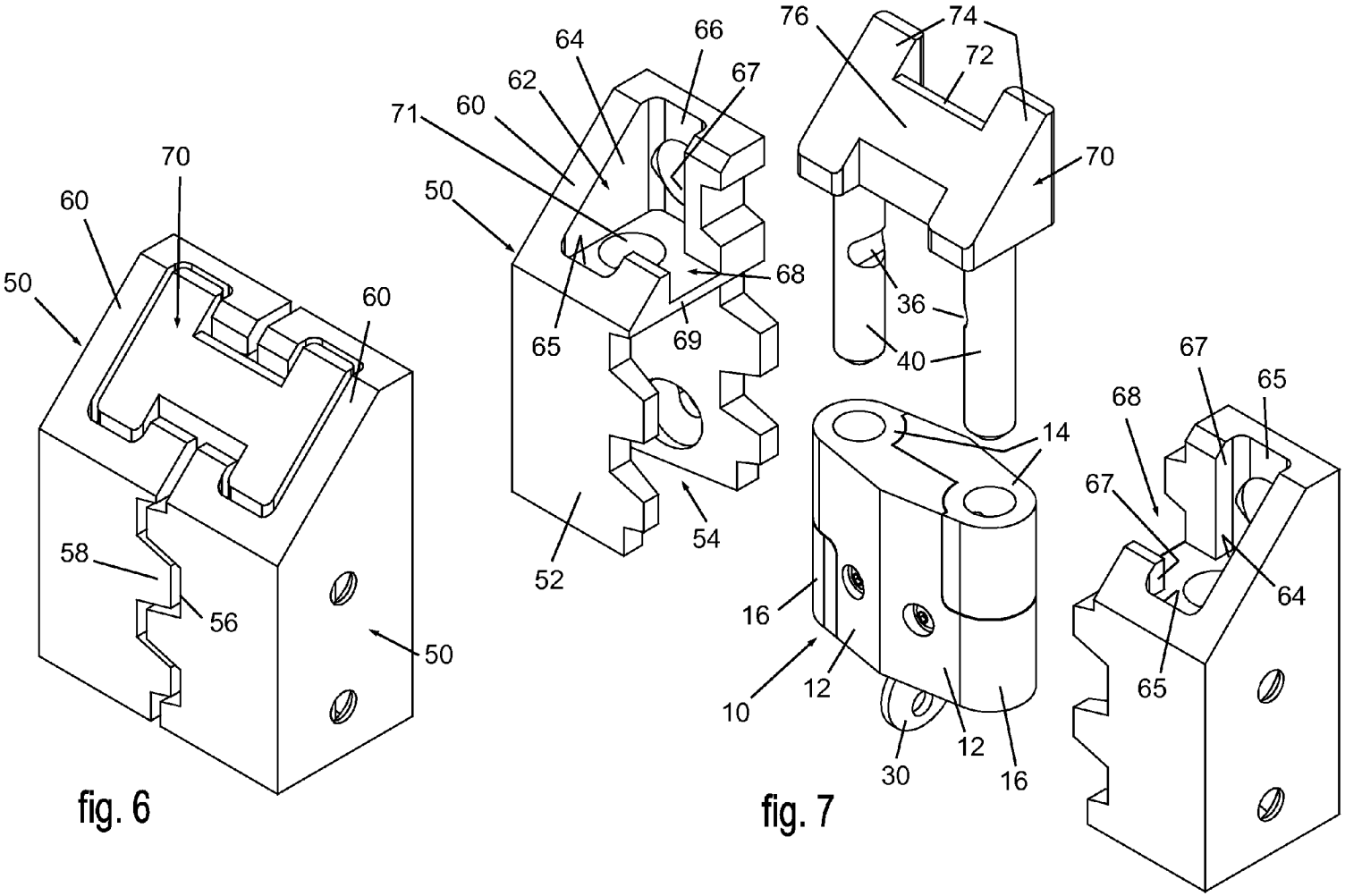
FIGS. 6 and 7 are simplified pictorial and exploded illustrations, respectively, of the padlock assembly of FIG. 1 installed in protective hasp members, in accordance with an embodiment of the present invention.

In the embodiment of FIG. 3, one or more resilient clasps 42 fasten padlock halves 12 together. Each resilient clasp 42 is formed with two outwardly extending tabs 44 at ends thereof, and fits into grooves 46 formed in padlock halves 12. A recess 48 is formed in padlock half 12 so that a tool (e.g., small flat blade screwdriver, not shown) can be inserted in recess 48 to dislodge clasp 42 from grooves 46 for disassembly, if needed.

It is important to note that in all of these embodiments, the two padlock halves 12 are interlocked with shackle 38. This means that even if the fasteners were not present, once the shackle is in the locked position, the two padlock halves 12 cannot be separated.

The padlock halves 12 may be made by investment casting or by other methods, such as machining.

Reference is now made to FIGS. 6-9, which illustrate the padlock assembly 10 installed in protective hasp members 50, in accordance with an embodiment of the present invention.

In the illustrated embodiment there are two protective hasp members 50. Each protective hasp member 50 includes a pair of wall extensions 52 separated by a gap 54 (also called padlock chamber 54). Wall extensions 52 are preferably, but not necessarily, formed with a plurality of intermeshing mortises 56 and tenons 58 positioned such that the tenons 58 of one of the protective hasp members 50 fit into the mortises 56 of the other protective hasp member 50.

Protective hasp members 50 each have an inclined (upper) surface 60, which is formed with a shackle-cutout 62 that defines a shackle-receiving chamber 62 bounded by an outer side wall 64, short front wall 65, a rear wall 66 and an inner side wall 67. The inner side wall 67 is formed with an aperture 68 to accommodate the top portion of a shackle 70. The shackle-receiving chamber 62 is separated from padlock chamber 54 by a floor 69. Floor 69 is formed with a hole 71 for the legs 40 of shackle 70 to pass through.

Shackle 70 has a top portion that includes a bar 72 and protruding side members 74 (e.g., forming an H-shape), all having an inclined surface 76. The side members 74 fit into the shackle-receiving chambers 62, and when fully seated therein, are prevented from moving forward, backward and sideways. The inclined surfaces 60 and 76, which may be matching inclined surfaces, add to the security of the complete assembly, because the force of any vandalistic blow to the inclined surfaces is divided into two vector components, one of which is wasted energy. The remaining vectorial force is much less than the applied force. This significantly reduces the force applied to break or damage the protective hasp members or to detach the protective hasp members from the door or other surface on which they are mounted.

Figure 9:
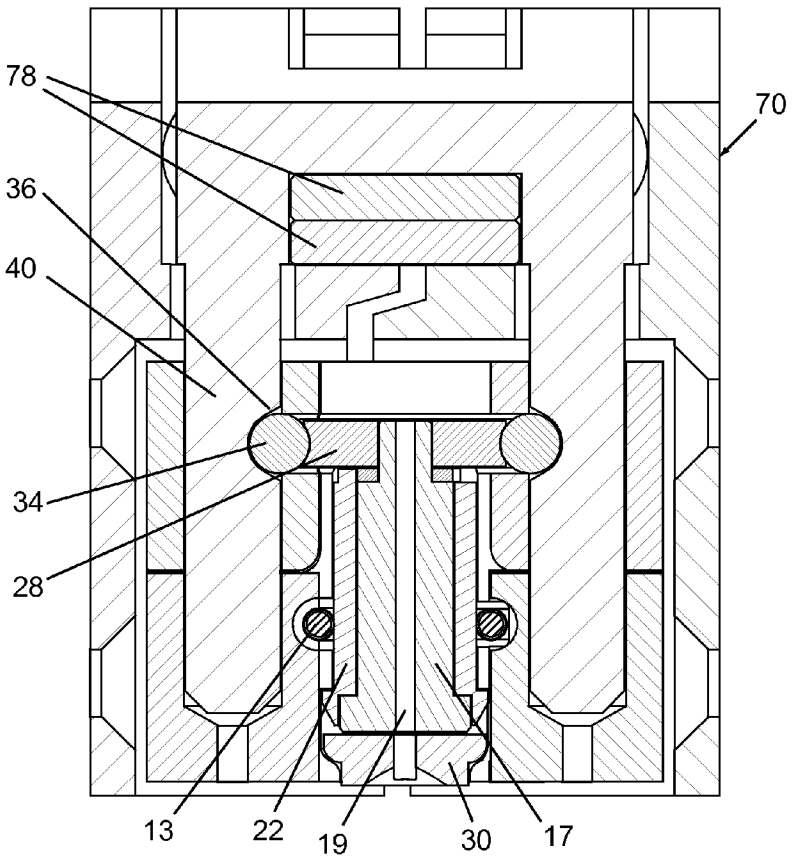
FIGS. 8 and 9 are simplified side-view and sectional illustrations, respectively, of the padlock assembly in the protective hasp members, with FIG. 9 being taken along lines A-A in FIG. 8.
Figure 8:
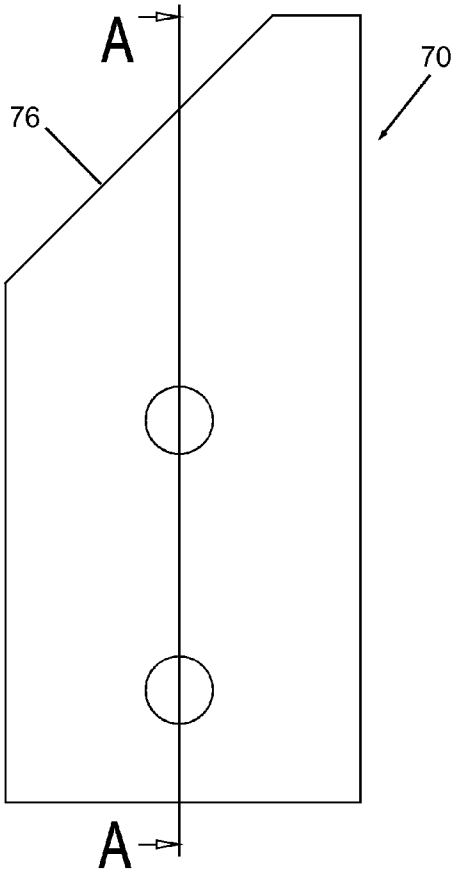
Figure 11:
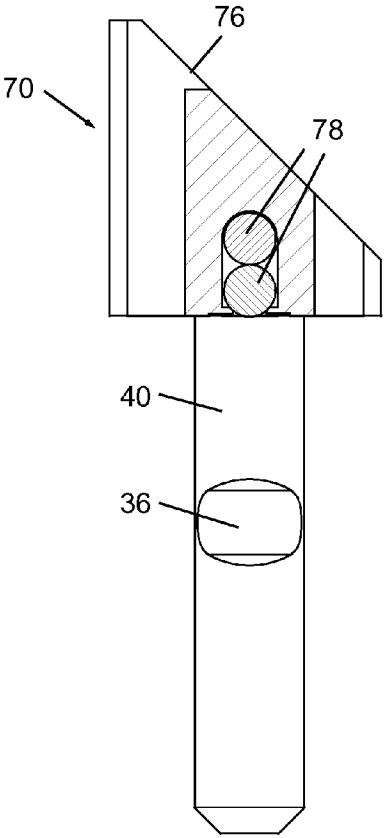
FIGS. 10 and 11 are simplified front-view and sectional view illustrations, respectively, of a shackle of the padlock assembly, with FIG. 11 being taken along lines B-B in FIG. 10, showing anti-vandalism elements (e.g., anti-sawing, anti-flame-cutting, intumescent and/or anti-corrosion elements) assembled in the shackle, in accordance with an embodiment of the present invention.
Figure 10:
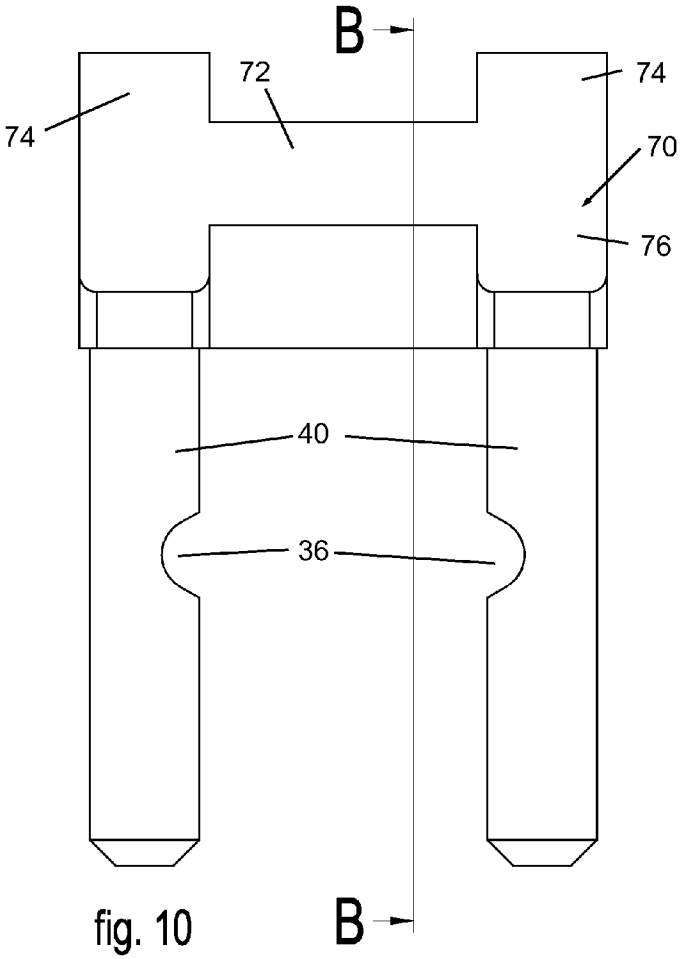

As seen in FIGS. 9 and 11, bar 72 of shackle 70 may be provided with anti-vandalism elements 78. In one example, elements 78 are anti-sawing elements, such as but not limited to, a soft metal (e.g., aluminum) that may clog a vandal's saw, or a material that is very difficult to saw or drill (e.g., tungsten carbide), or a combination of such elements (one soft and one hard). In another example, elements 78 are anti-flame-cutting elements, such as but not limited to, magnesium bars or rods that give off smoke upon heating. In another example, elements 78 are intumescent elements that swell upon heating. In another example, elements 78 are self-sacrificing anti-corrosion elements, such as but not limited to, zinc powder, which help prevent corrosion of the shackle. Any combination of the above may be used.

However, it is noted that when the shackle 70 is locked in place, even if bar 72 were to be cut or otherwise destroyed, the would-be vandal would still not gain anything. This is because the protruding side members 74 are still prevented from moving and the legs 40 of shackle 70 are still locked in place.

It is noted that the shackle does not have to include such thick and robust side members and bar. Instead, the shackle can be made similarly as in FIG. 1, but with the bar deformed to protrude outwards to fit into correspondingly-made shackle-receiving chambers.

Figure 14:
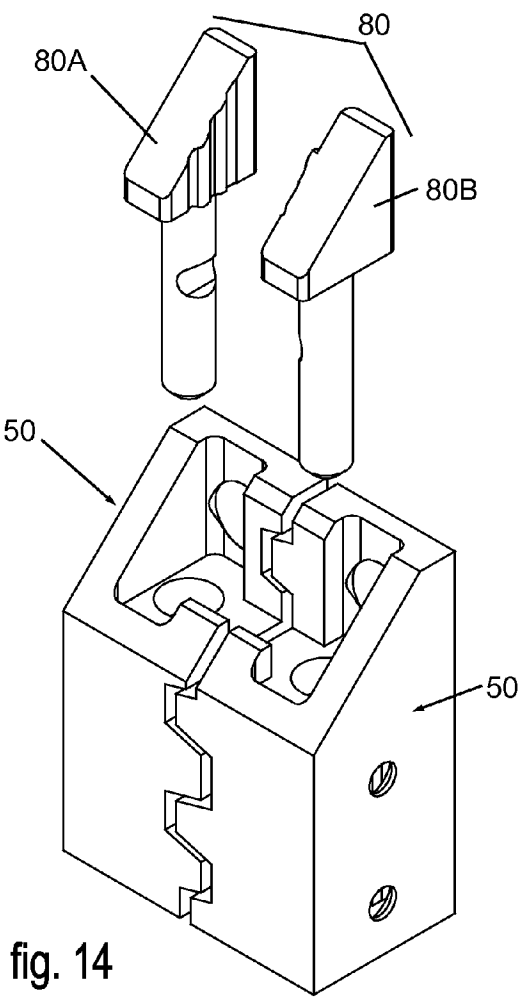
FIGS. 12, 13 and 14 are simplified front-view, sectional view and exploded illustrations, respectively, of the padlock assembly with a shackle that includes two separate members. This emphasizes a feature of the invention, namely, that even if the bar of the shackle is cut (the bar being the part of the shackle that extends horizontally between the tops of the shackle legs), the padlock assembly remains intact in the protective hasp members and continues to securely lock whatever is intended to be locked.
Figure 12:
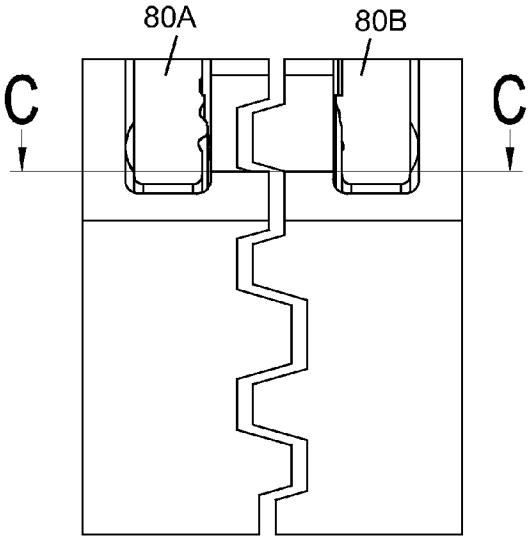
Figure 13:
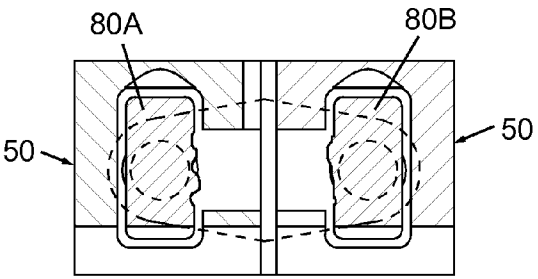

Reference is now made to FIGS. 12, 13 and 14, which illustrate another modification of the padlock assembly. In accordance with an embodiment of the invention, shackle 80 has been flame cut into two separate members 80A and 80B. This embodiment emphasizes the feature just described before with respect to shackle 70: here there is no bar at all, and yet the padlock assembly remains intact in the protective hasp members and continues to securely lock whatever is intended to be locked. This is because the protruding side members are still prevented from moving and the legs of shackle 80 are still locked in place.

What is claimed is:

1. A padlock assembly comprising:

two identical halves fastened with at least one fastener;

a cylinder lock assembled with said padlock halves; and a shackle with legs that are receivable in said padlock halves and lockable with said cylinder lock;

wherein said padlock halves are interlocked with said shackle such that even if said at least one fastener is removed, if said shackle is in a locked position with said cylinder lock, said two padlock halves cannot be separated from each other.

2. The padlock assembly according to claim 1, wherein said at least one fastener comprises at least one threaded fastener.

3. The padlock assembly according to claim 1, wherein said at least one fastener comprises at least one resilient clasp.

4. A padlock assembly comprising:

two padlock halves fastened with at least one fastener;

a cylinder lock assembled with said padlock halves; and a shackle with legs that are receivable in said padlock halves and lockable with said cylinder lock;

wherein said padlock halves are interlocked with said shackle such that even if said at least one fastener is removed, if said shackle is in a locked position with said cylinder lock, said two padlock halves cannot be separated from each other, and wherein each of said padlock halves comprises first and second shackle receiving members, and the first shackle receiving member of one of the halves sits over the second shackle receiving member of the other half.

5. The padlock assembly according to claim 1, wherein each of said padlock halves comprises a first groove for receiving therein said cylinder lock and second groove for receiving therein a locking cam of said cylinder lock.

6. The padlock assembly according to claim 1, further comprising protective hasp members which comprise a padlock chamber for receiving therein said padlock halves and said cylinder lock and a shackle-receiving chamber for receiving therein said shackle.

7. The padlock assembly according to claim 6, wherein said shackle comprises protruding side members that fit into said shackle-receiving chamber, such that when said shackle is in the locked position with said cylinder lock, even if said shackle is damaged so that legs of said shackle are separated from each other, said protruding side members are prevented from moving out of said shackle-receiving chamber and legs of said shackle remain locked in place with said cylinder lock.

8. The padlock assembly according to claim 6, wherein said shackle and said protective hasp members comprise matching inclined surfaces.

9. The padlock assembly according to claim 1, wherein said shackle comprises anti-vandalism elements.

10. The padlock assembly according to claim 9, wherein said anti-vandalism elements comprise at least one of anti-sawing, anti-flame-cutting, intumescent and anti-corrosion elements.

11. The padlock assembly according to claim 1, wherein said cylinder lock comprises an anti-tampering disk which has a greater diameter than said cylinder lock.

12. A padlock assembly comprising:

two padlock halves fastened with at least one fastener, said padlock halves having outer surfaces which are outermost surfaces of said padlock assembly;

a cylinder lock assembled with said padlock halves; and a shackle with legs that are receivable in said padlock halves and lockable with said cylinder lock;

wherein said padlock halves are interlocked with said shackle such that even if said at least one fastener is removed, if said shackle is in a locked position with said cylinder lock, said two padlock halves cannot be separated from each other.

* * * * *